US005103888A

United States Patent [19]

Nakamura

[11] Patent Number: 5,103,888

[45] Date of Patent: Apr. 14, 1992

[54] BLIND SLATS LIFTING DEVICE

[75] Inventor: Motoaki Nakamura, Funabashi, Japan

[73] Assignee: Tachikawa Corporation, Japan

[21] Appl. No.: 636,320

[22] Filed: Dec. 28, 1990

[51] Int. Cl.[5] ..... E06B 9/30

[52] U.S. Cl. ..... 160/171

[58] Field of Search ..... 160/171, 170, 168.1, 160/176.1, 177, 178.1, 166.1, 173

[56] References Cited

U.S. PATENT DOCUMENTS

| | | | |
|---|---|---|---|
| 3,089,664 | 5/1963 | Faber | 160/170 X |
| 3,181,595 | 5/1965 | Pender | 160/171 |
| 3,352,349 | 11/1967 | Hennequin | 160/178.1 X |
| 4,200,135 | 4/1980 | Hennequin | 160/168.1 |
| 4,955,421 | 9/1990 | Torti | 160/170 X |

FOREIGN PATENT DOCUMENTS

| | | | |
|---|---|---|---|
| 248439 | 1/1963 | Australia | 160/171 |
| 56-23036 | 5/1981 | Japan . | |
| 63-29108 | 8/1988 | Japan . | |

*Primary Examiner*—David M. Purol

[57] ABSTRACT

A pair of lifting cords are connected to a bottom rail at their lower ends and are connected to ends of a head box at their upper ends so as to lift and lower the slats of a blind. A pair of winding drums are provided in the head box which rotate together and move in the longitudinal direction of the head box. The lifting cords are introduced into the head box at the ends thereof. The lifting cords are guided so as to extend in the moving direction of the winding drums and are fitted to the wind starting ends of the winding drums. The moving ranges of the winding drums are set inside relative to the lifting cord introducing portions. As the winding drums rotate, the lifting cords are wound around the outer periphery of the winding drums. As the lifting cords are wound, the slats are lifted and lowered.

11 Claims, 7 Drawing Sheets

BLIND SLATS LIFTING DEVICE

BACKGROUND OF THE INVENTION

1. Field of the Invention

The present invention relates generally to a blind. More particularly, a blind slats lifting device is proposed, wherein a lifting cord is wound about a winding drum which rotates and moves in the longitudinal direction of a head box.

2. Description of the Related Art

Slat lifting devices are well known when used in window blinds. One of the conventional lifting devices is shown in FIG. 12. In this device, an operation cord 42 is hung from an end of a head box 41. A pair of winding drums 43 are provided in the head box. The winding drums 43 can rotate, and can also move in the axial direction thereof. By operating the operation cord 42, lifting cords 44 are wound about the winding drums 43 to lift slats 45.

When the slats 45 remain at their lowest position, the winding drums 43 are placed at positions shown as solid lines in FIG. 12. When the slats 45 are lifted up to the top position, the drums 43 move to positions shown as two-dot chain lines in FIG. 12. The moving stroke of the drums 43 depends on the winding length of the lifting cords and the diameter of the winding drums 43.

In the foregoing slats lifting device, a spacing L1 must be reserved between a wind starting position of the lifting cord 44 and an end of the head box 41. The space must be longer than the stroke of the winding drum 43 in order to prevent the drums 43 from protruding from the ends of the head box 41. Accordingly, the slats 45 also protrude outwardly the same distance from positions where ladder cords 46 support the slats 45. The slats 45 are longer than an interval between the ladder cords 46 by twice the protrusion length L1. It may cause drooping, warping and bending of the slats 45 and uneven alignment at times of angle adjustment. In the foregoing slats lifting device as described above, it is difficult to provide a blind with a minimum length substantially equal to housing lengths of the winding drums 43.

SUMMARY OF THE INVENTION

A primary object of the present invention is to provide a slats lifting device wherein a protrusion length of slats from slat supporting positions can be made relatively short regardless of the moving stroke of winding drums.

A second object of the present invention is to provide a slats lifting device wherein a lifting cord guide arrangement can be effectively positioned in a limited space.

A third object of the present invention is to provide a slats lifting device wherein the same parts can be used for both right and left lifting cords, to reduce production costs.

To achieve the foregoing and other objects and in accordance with the purposes of the present invention, an improved slats lifting device is proposed. According to the present invention, a blind has a head box, a bottom rail hung by a pair of ladder cords coming down from both ends of the head box, and a plurality of slats. The slats are provided between the head box and the bottom rail and are supported by the ladder cords. A pair of lifting cords are provided adjacent the ladder cords to lift the slats. Lower ends of the lifting cords are connected to both ends of the bottom rail, and upper ends thereof are connected to both ends of the head box. A pair of winding drums are provided in the head box and can rotate integrally. The winding drums can also move along the length of the head box. As the drums rotate, the lifting cords are wound around the outer periphery of the drums.

The lifting cords are introduced into the head box from the ends thereof. Then, the lifting cords are guided so as to extend along the moving direction of the winding drums and are fitted to wind starting ends of the winding drums. The moving spans of the winding drums are located inwardly relative to the lifting cord introducing positions. Accordingly, when the lifting cords are wound, the drums will not move outward beyond the lifting cord introducing positions, so that an interval between the drums and the ends of the head box can be reduced.

BRIEF DESCRIPTION OF THE DRAWING

The features of the present invention that are believed to be novel are set forth with particularity in the appended claims. The invention, together with the objects and advantages thereof, may best be understood by reference to the following description of the presently preferred embodiments together with the accompanying drawings in which:

DETAILED DESCRIPTION OF THE PREFERRED EMBODIMENT

Figure 1:
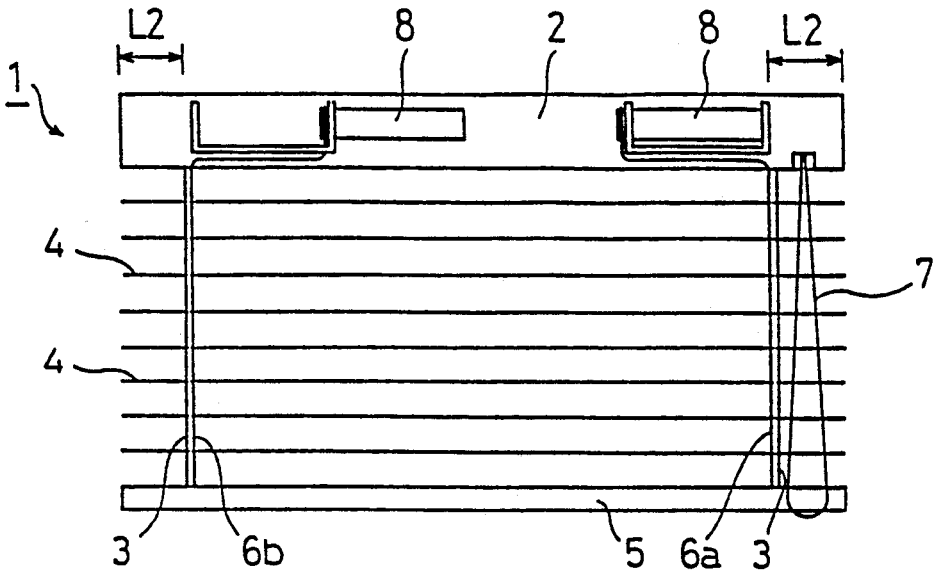
FIGS. 1 and 2 are schematic views of a slats lifting device of one embodiment of the present invention, showing operations thereof.

As illustrated in the drawings, a preferred embodiment of the present invention will be described in detail hereinafter.

In a blind 1 shown in FIG. 1, a pair of ladder cords 3 are hung from ends of the head box 2. A multiplicity of slats 4 are supported by the ladder cords 3 which hang and support a bottom rail 5 at the lowest ends thereof. Adjacent to and along the ladder cords 3, a pair of right and left lifting cords **6*a* and 6*b* are also hung. The lifting cords 6*a* and 6*b* penetrate the slats 4 and have the lowest ends thereof connected to the bottom rail 5**.

An operation cord 7 is hung from a right end of the head box. When the operation cord 7 is operated in a lifting direction, a pair of winding drums provided in the head box wind the lifting cords **6*a* and 6*b* thereabout. Thus, the bottom rail 5** is lifted, so that the slats 4 are also lifted. As described, the winding drums are threaded and wind the lifting cords 6*a* and 6*b*.

A detailed design of the slats lifting device is now explained. In the head box 2, a right lifting mechanism 9 shown in FIG. 3 and a left lifting mechanism 10 shown in FIG. 4 are housed in the head box 2. A hexagonal bar shape drive shaft 11 penetrates both the lifting mechanisms 9 and 10. When the drive shaft 11 rotates, the right and left lifting cords 6*a* and 6*b* are wound or unwound.

Figure 3:
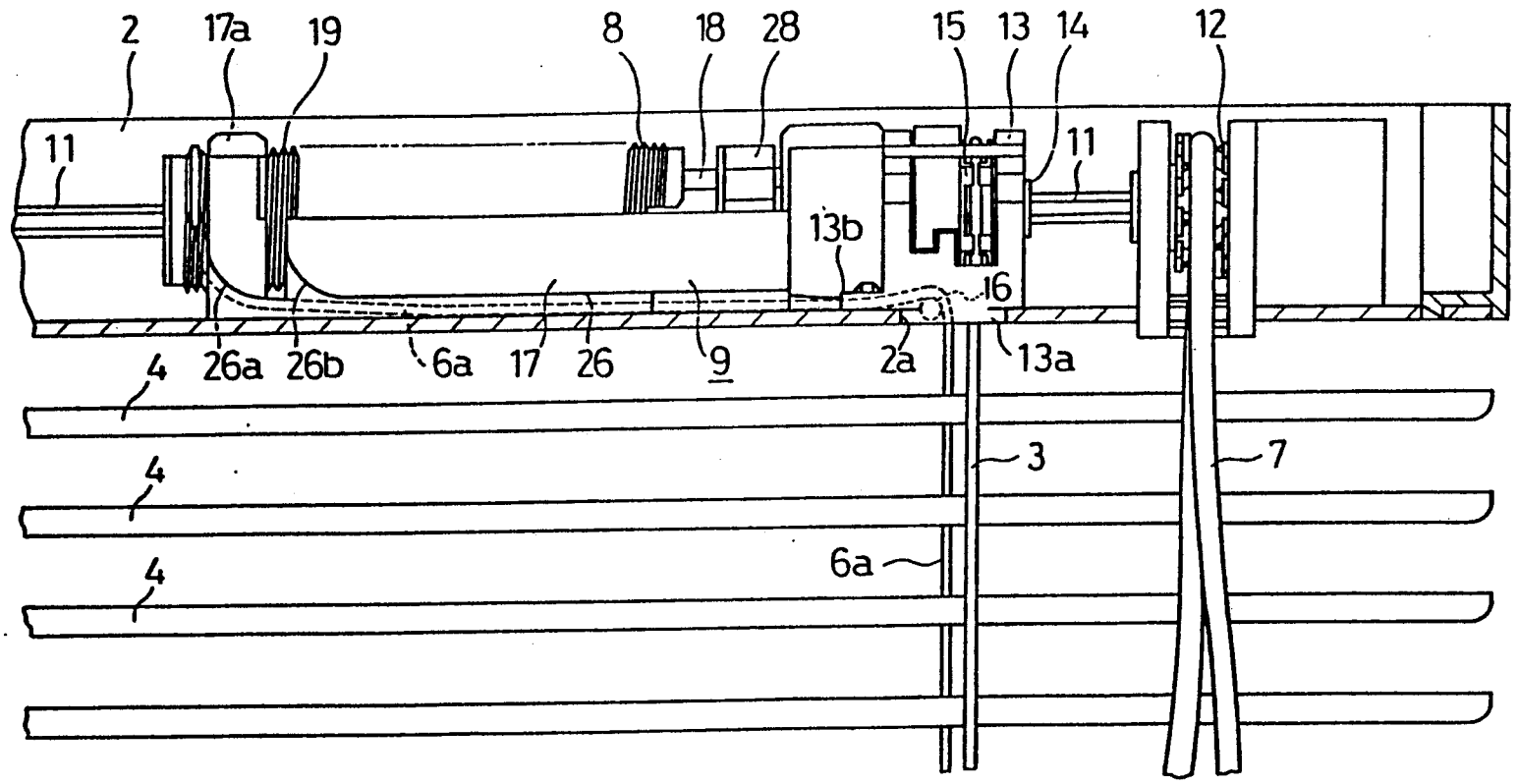
FIG. 3 is a front view of a right side lifting mechanism.
Figure 4:
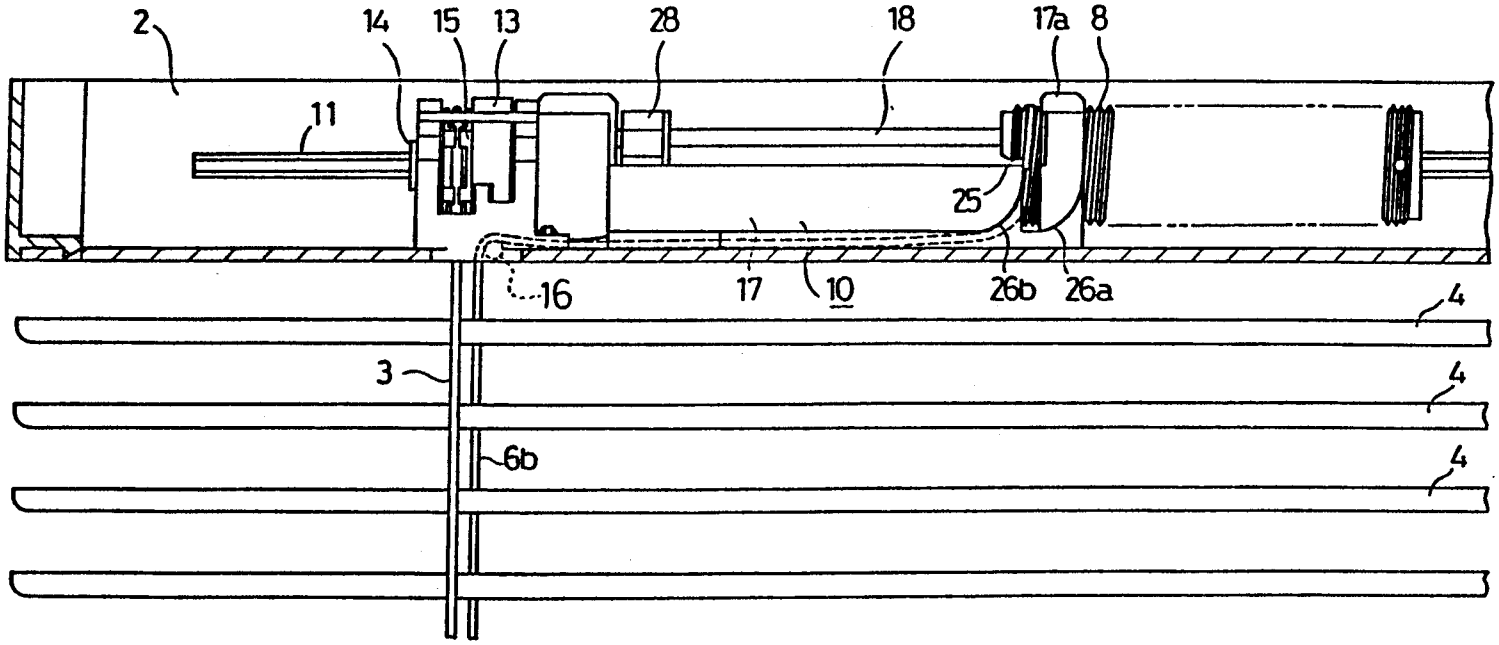
FIG. 4 is a front view of a left lifting mechanism.

As shown in FIG. 3, a drive pulley 12 is fitted to the drive shaft 11 at a right side of the head box 2 relative to the right lifting mechanism 9. The operation cord 7 is hooked around the drive pulley 12. Upon operation of the operation cord 7, the drive shaft 11 can rotate in either direction via the drive pulley 12.

Figure 7:
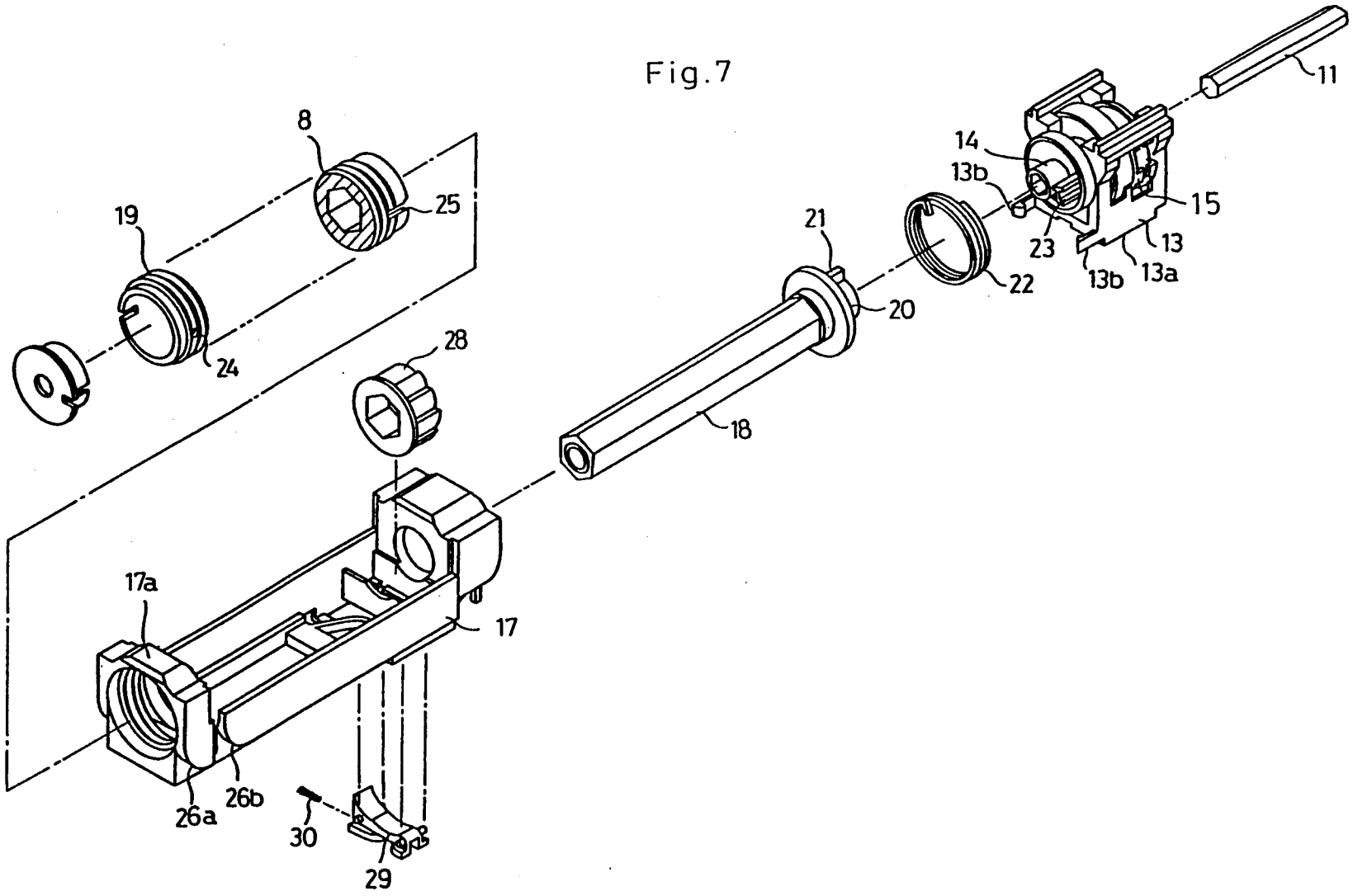
FIG. 7 is an exploded perspective view of the right lifting mechanism.

A tilt case 13 is provided at a right end of the right lifting mechanism 9. A transmitting shaft 14 shown in FIG. 7 is rotatably supported on the tilt case 13. The transmitting shaft 14 receives the drive shaft 11 and can rotate integrally with the drive shaft 11. A tilt pulley 15 journals the outside of the transmitting shaft 14, to which the upper end of one of the ladder cords 3 is connected.

A generally known rotation restricting mechanism is included in the tilt pulley 15. That is, a rotation restricting piece (not shown) is formed at the tilt pulley 15 and engages with the tilt case 13. When the rotation restricting piece is not engaged with the tilt case 13, the tilt pulley 15 can rotate together with the transmitting shaft 14. As the drive shaft 11 rotates, the tilt pulley 15 rotates with the transmitting shaft 14 so as to tilt the slats 4 via the ladder cords 3. When the slats 4 are tilted and come to substantially vertical postures, the rotation restricting piece engages the tilt case. Thus, the additional rotation of the tilt pulley 15 is restricted, and the tilt pulley 15 will not rotate in the same direction any more. The transmitting shaft 14 then rotates free of the tilt pulley 15.

A fitting tongue 13*a* protrudes from the bottom of the tilt case 13. A fitting hole 2*a* corresponding to the fitting tongue 13*a* is provided at the head box 2. As shown in FIG. 3, the fitting tongue 13*a* is set into the fitting hole 2*a* such that the tilt case 13 is fixed to the head box 2. A support frame 17 is provided in the head box 2 at a left side relative to the tilt case 13. A pair of hooking pieces 13*b* are formed at a left side of the tilt case 13. The hooking pieces 13*b* engage with an end of the support frame 17 such that the support frame 17 is fixed in the head box 2. Accordingly, fixing means such as screws or the like are not required to secure the support frame 17 to the head box 2.

A guide roller 16 is rotatably supported at a lower portion of the tilt case 13. The guide roller 16 guides the right lifting cords 6*a* inwardly toward the support frame 17.

Figure 5:
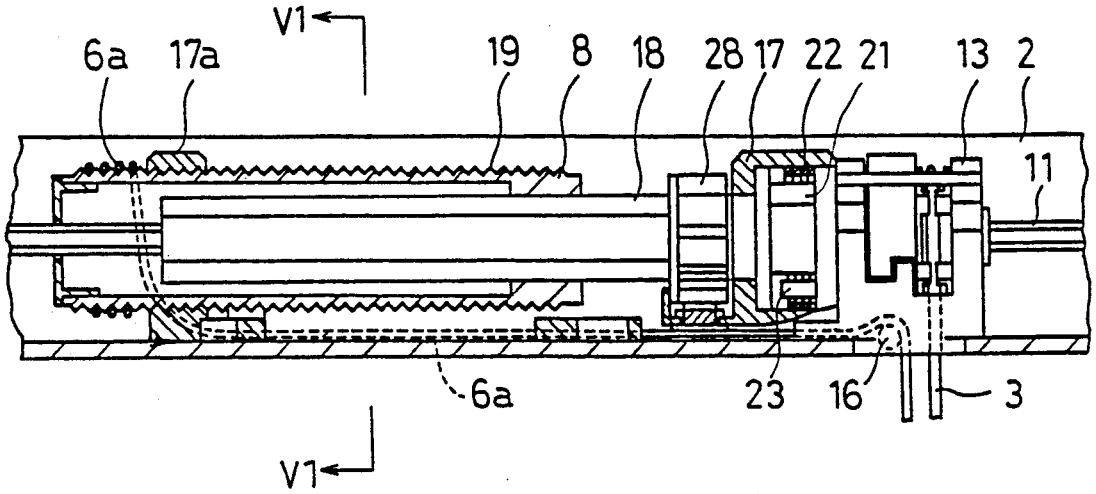
FIG. 5 is a longitudinal sectional view of the right lifting mechanism.
Figure 6:
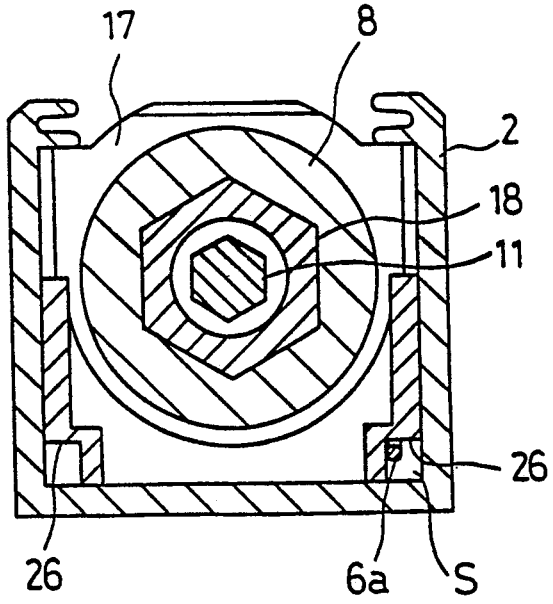
FIG. 6 is a sectional view of the right lifting mechanism taken along the line VI—VI in FIG. 5.

As shown in FIG. 6, a hexagonal pipe shape support shaft 18 is rotatably supported on the support frame 17. The support shaft 18 is inserted into the winding drum 8 which will not rotate relative to the support shaft 18 but can move in the axial direction thereof. A male thread 19 is defined on the outer periphery of the winding drum 8. A threaded bore 17*a* is formed at an inner end of the support frame 17, namely at the left end in FIG. 5. The threaded bore 17*a* meshes with the winding drum 8. Accordingly, when the support shaft 18 rotates, the winding drum 8 rotates together with the support shaft 18 and moves in the axial direction relative to the support shaft 18.

As shown in FIGS. 5 and 7, a round shaft 20 is formed at the right end of the support shaft 18. An inner cam 21 is defined at the outer periphery of the round shaft 20 and protrudes diametrically. Around the inner cam 21, a torsion coil spring 22 is provided at the inner periphery of the support frame 17. An outer cam 23 is formed at the tip of the transmitting shaft 14 and protrudes to the inside of the torsion coil spring 22. Thus, a known device for preventing the slats from falling down due to their own weight is provided.

That is, a rotational force generated upon operation of the operation cord 7 is transmitted to the support shaft 18 after the outer cam 23 comes to contact with the inner cam 21. Then, after angles of the slats 4 are adjusted via the tilt pulley 15 and the ladder cords 3 according to rotations of transmitting shaft 14, the slats 4 start being lifted. A rotational force loaded on the support shaft 18 due to the weight of the bottom rail 5 and the slats 4 will not be transmitted to the transmitting shaft 14 because it is absorbed by the torsion coil spring 22.

Figure 8:
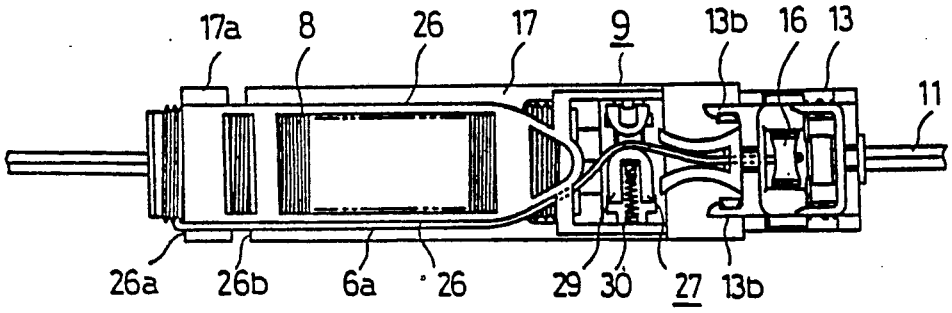
FIG. 8 is a bottom view of the right lifting mechanism.

As shown in FIG. 7, an engaging hole 24 is formed at an inner end of the winding drum 8 and an engaging groove 25 is formed at the outer end thereof. As shown in FIGS. 6 and 8, a pair of guide recesses 26 for guiding the lifting cords 6*a* and 6*b* are defined at both sides of the bottom surface of the support frame 17. An end of one of the guide recesses 26 is divided into two. One is defined as a first leading-out portion 26*a* for guiding the lifting cord to the winding drum 8 at a first side relative to the threaded bore 17*a*. The other is defined as a second leading-out portion 26*b* for guiding the lifting cord to the winding drum 8 at a second side relative to the threaded bore 17*a*.

As shown in FIG. 8, the right lifting cord 6*a* goes through the guide roller 16 and a latch mechanism 27 and is led to one of the guide recesses 26, namely the guide recess 26 shown in FIGS. 3 and 5. As shown in FIG. 6, the right lifting cord 6*a* is further fed through a gap S defined between the guide recess 26 and a corner of the head box 2 to the inner end of the support frame 17. Then, it passes through the first leading-out portion 26*a* to be wound around the winding drum 8. The end of the right lifting cord 6*a* is fixed to the end of the winding drum 8. When the support shaft 18 is rotated in the slat lifting direction upon operation of the operation cord 7, the winding drum 8 rotates and moves leftward in FIG. 3. As a result, the right lifting cord 6*a* is wound around the winding drum 8 along its male thread 19 as shown in FIG. 5.

Figure 9:
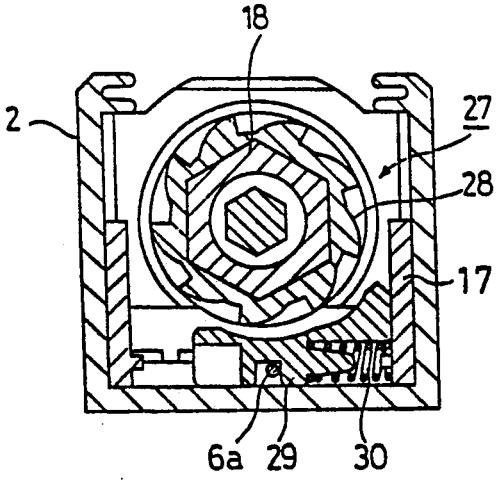
FIGS. 9 and 10 are sectional views of a latch mechanism, showing operations thereof.
Figure 10:
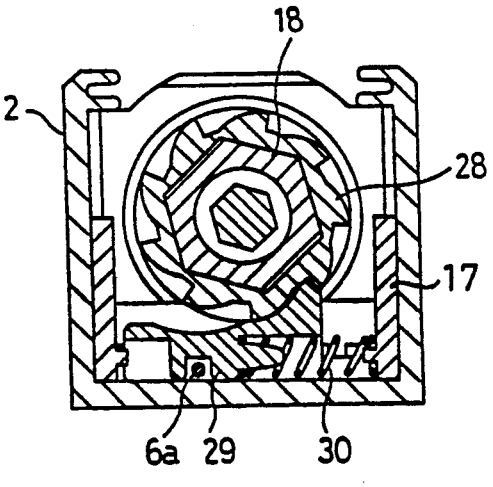

The latch mechanism 27 shown in FIGS. 7 to 10 forces the slats to stop their descending operation when the bottom rail 5 hits an obstacle during the descending operation. As shown in FIGS. 7 and 9, a ratchet wheel 28 is fitted to the support shaft 18. Under the ratchet wheel 28, a meshing slider 29 is supported on the bottom surface of the support frame 17. The meshing slider 29 slides in the diametrical direction of the ratchet wheel 28. A coil spring 30 is provided between the meshing slider 29 and the inner side surface of the support frame 17. The coil spring 30 urges the meshing slider 29 toward the ratchet wheel 28. The right lifting cord 6*a* is inserted through the meshing slider 29.

When the right lifting cord 6*a* bears a load and is tightened because of the weight of the bottom rail 5 and the slats 4, the meshing slider 29 is located at a position where the meshing slider 29 does not mesh the ratchet wheel 28 against the urging force of the coil spring 30 as shown in FIG. 9. When the right lifting cord 6a is loosened as the bottom rail 5 collides with an obstacle or the like, the coil spring 30 brings the meshing slider 29 to a position where the meshing slider 29 meshes with the ratchet wheel 28 so as to stop the rotation of the support shaft 18 in the descending direction of the slats. At the same time, the lifting cord 6a is bent by the meshing slider 29 and bears resistance so as not to move.

A left lifting mechanism 10 shown in FIG. 4 is provided by flipping the right lifting mechanism 180 degrees. The winding drum 8 at the left lifting mechanism 10 rotates in the same direction together with the winding drum 8 at the right lifting mechanism 9 and moves in the axial direction thereof as the drive shaft 11 rotates. The left lifting cord 6b goes through the guide recess 26 at the bottom surface of the support frame 17 and the second leading-out portion 26b to the left side of the threaded bore 17a. Then, the left lifting cord 6b is wound around the winding drum 8. The end of the left lifting cord 6b is fixed within the engaging groove 25 at the drum 8.

Operations of the foregoing lifting device is now described.

When the slats 4 and the bottom rail 5 descend to the lowest point, the winding drum 8 of the right lifting mechanism 9 is positioned substantially inside the support frame 17 as shown in FIG. 3, and the winding drum 8 of the left lifting mechansim 10 is positioned substantially outside the support frame 17.

Figure 2:
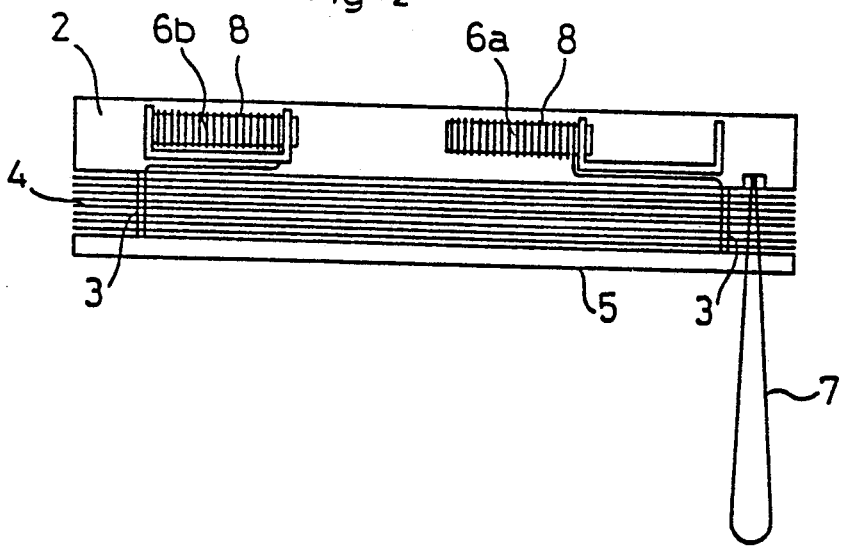

In the above state, when the operation cord 7 is operated so as to rotate the drive shaft 11 in the ascending direction, the support shafts 18 are rotated in the same direction via the transmitting shafts 14. In accordance with the rotation, the winding drums 8 rotate and move leftward in FIGS. 3 and 4. Then, the right lifting cord 6a is succesively wound around the right winding drum 8, and the left lifting cord 6b is successively wound around the left winding drum 8. When the bottom rail 5 comes to the uppermost position, a state shown in FIG. 2 is achieved.

When the slats 4 are to be lowered, the operation cord 7 is operated in the opposite direction. Thus, both the right and left drums 8 rotate in the reverse direction and move rightward so as to unwind the lifting cords 6a and 6b. The slats 4 and the bottom rail 5 go down by their own weight. If the bottom rail 5 hits an obstacle and at least either the lifting cords 6a or 6b is loosened, the latch mechanism 27 operates to stop the operation of the operation cord 7 in the descending direction.

Figure 11:
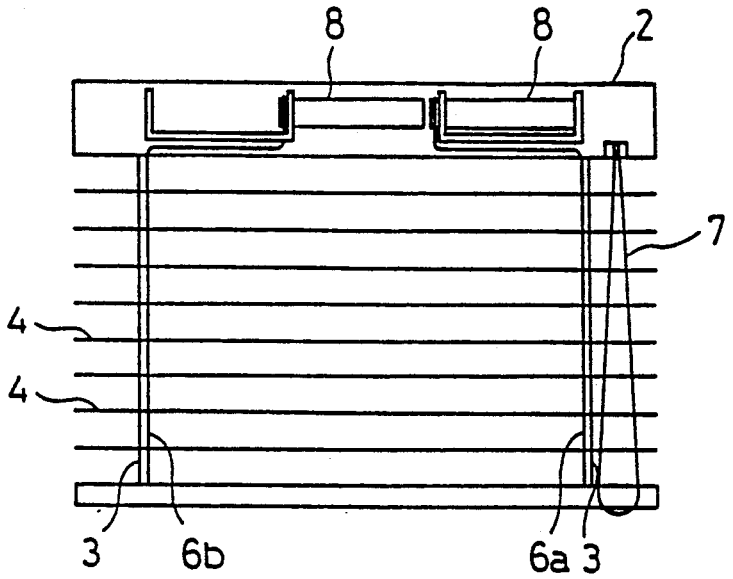
FIG. 11 is a schematic view of the blind wherein the length thereof is minimized.
Figure 12:
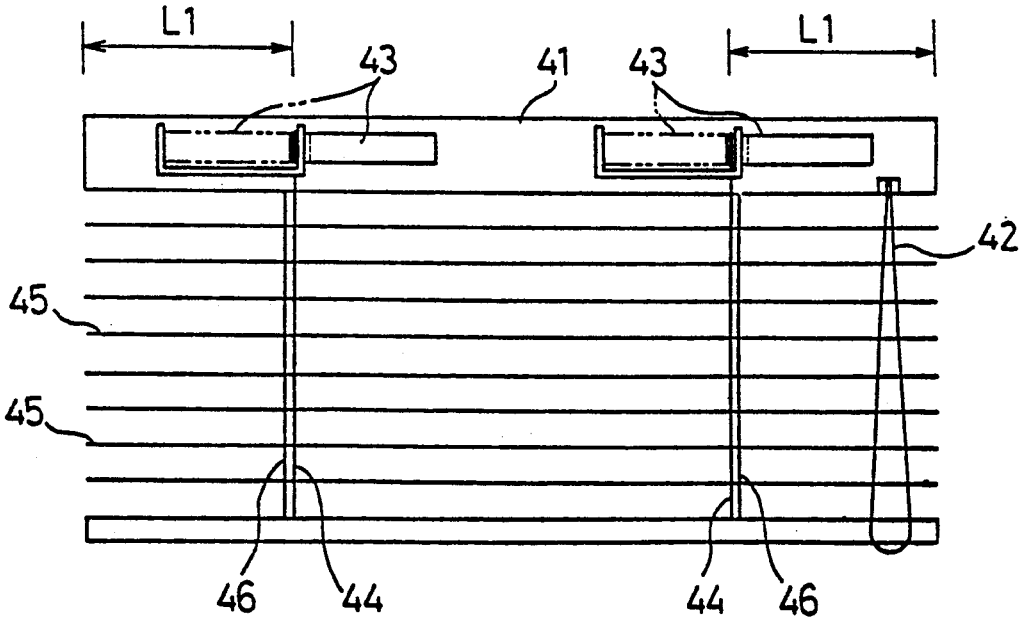
Fig.12(prior art)
FIG. 12 is a schematic view of a prior art slat lifting device.

As described above, in the slats lifting device of the present invention, the lifting cords 6a and 6b are guided inwardly along the support frame 17 in the head box 2. The lifting cords 6a and 6b are wound around the winding drums 8 rotating and moving at relatively inside positions. Therefore, as shown in FIG. 1, the protrusion lengths L2 which the head box 2 and the slats 4 must extend beyond the lifting cords 6a and 6b, can be set at a small amount regardless of the moving stroke of the winding drums 8. As shown in FIG. 11, a blind having the narrowest length can be produced, wherein an interval between the lifting cords 6a and 6b is made about three times longer than the moving stroke of the winding drums 8. This narrow blind can also be supported by the ladder cords 3 at the end portions of the slats 4.

The guide recesses 26 are formed at both the side portions of the bottom surface of the support frame 17 for the purpose of guiding the lifting cords 6a and 6b to the winding positions. The lifting cords 6a and 6b are guided in the gaps S defined between the guiding recesses 26 and the corners of the head box 2. Accordingly, any additional space for guiding the lifting cords 6a and 6b is unnecessary at the support frame 17, so that the head box 2 can be made relatively small.

Either the first or second leading-out portion 26a or 26b can be selected at the lifting mechanisms 9 and 10 so as to change the leading-out positions of the lifting cords 6a and 6b to the winding drums 8. Accordingly, the same parts can be used in both the right and left lifting mechanisms 9 and 10, resulting in a relatively low production cost.

Although only one embodiment of the present invention has been described herein, it should be apparent to those skilled in the art that the present invention may be embodied in many other specific forms without departing from the spirit or scope of the invention.

For example, instead of the winding drums 8 having the male thread at the outer peripheral surface thereof, smooth surfaced winding pipes can be provided which have the lifting cords wound thereabout.

Therefore, the present examples and embodiments are to be considered as illustrative and not restrictive and the invention is not to be limited to the details given herein, but may be modified within the scope of the appended claims.

What is claimed is:

1. A slat lifting mechanism for a blind comprising:

a head box having a central portion and opposing end portions;

a pair of ladder cords hung from the opposing end portions of the head box;

a bottom rail carried by the ladder cords;

a plurality of slats disposed between the head box and the bottom rail, the slats being raised in accordance with the lifting of the bottom rail;

a pair of lifting cords for lifting the slats, each lifting cord being disposed adjacent to an associated ladder cord, wherein the lower ends of the lifting cords are connected to the bottom rail and the upper ends of the lifting cords are introduced into the head box at respective introducing positions that are located at opposing end portions of the head box; and a pair of winding drums positioned within the central portion of the head box, the winding drums being mounted such that they are integrally rotatable and longitudinally slidable within the head box, the winding drums being arranged to wind the lifting cords spirally around the periphery of the winding drums in accordance with the rotation thereof;

wherein the lifting cords are arranged to extend substantially longitudinally within the head box towards a respective winding position located in a central portion of the head box, the lifting cords being wound about the winding drums from said winding positions; and wherein the sliding range of each winding drum is set substantially in between the introducing positions of the lifting cords.

2. A blind having a slat lifting mechanism as recited in claim 1 wherein each winding drum includes a spiral groove for winding the lifting cord, the spiral groove being formed on the periphery of the winding drum.

3. A blind having a slat lifting mechanism as recited in claim 2 wherein the winding drum is supported on the support frame through the spiral groove.

4. A blind having a slat lifting mechanism as recited in claim 1 wherein both said winding drums are arranged on a single axis.

5. A slat lifting mechanism for a blind comprising:

a head box having a central portion and opposing end portions;

a pair of ladder cords hung from the opposing end portions of the head box;

a bottom rail carried by the ladder cords;

a plurality of slats disposed between the head box and the bottom rail, the slats being raised in accordance with the lifting of the bottom rail;

a pair of lifting cords for lifting the slats, each lifting cord being disposed adjacent to an associated ladder cord, wherein the lower ends of the lifting cords are connected to the bottom rail and the upper ends of the lifting cords are connected to the head box;

a pair of winding drums positioned within the central portion of the head box, the winding drums being mounted such that they are integrally rotatable and longitudinally slidable within the head box, the winding drums being arranged to wind the lifting cords spirally around the periphery of the winding drums in accordance with the rotation thereof;

wherein the lifting cords are introduced into introducing positions of the head box located in the opposing end portions thereof and are guided into the inner central portion of the head box along the sliding direction of the winding drums, each lifting cord being fixed to a winding starting end of an associated winding drum; and wherein the sliding range of each winding drum is set in between the introducing positions of the lifting cords; and a pair of support frames disposed at the opposing end portions of the head box, the support frames each carrying an associated winding drum, guide recesses formed on the bottom surface of the support frame extending along the sliding direction of the winding drums at both sides of the each support frame, and wherein the lifting cords are inserted between the guide recesses and the head box.

6. A blind having a slat lifting mechanism as recited in claim 5 further comprising a guide roller for guiding each lifting cord toward the guide recess, the guide roller being positioned to the introducing position of each winding cord.

7. A blind having a slat lifting mechanism as recited in claim 6 further comprising a latch mechanism for stopping the downward movement of the slats, the latch mechanism being provided between the guide roller and the guide recess, and the latch mechanism comprising:

a ratchet wheel rotated integrally with the winding drum;

a ratchet for engaging the ratchet wheel, the lifting cord being passed through the ratchet;

a spring for urging the ratchet to engage with the ratchet wheel; and wherein the ratchet is generally positioned away from the ratchet wheel against the spring force and in accordance with the tension to the lifting cord based on the weight of the bottom rail, and the rotation of the ratchet wheel is stopped through engaging with the ratchet in response to the spring force when the tension to the lifting cord is removed.

8. A blind having a slat lifting mechanism as recited in claim 7 wherein the ratchet is slidably mounted to the bottom face of the head box.

9. A blind having a slat lifting mechanism as recited in claim 5 wherein a portion of the guide recess nearest said winding drum is divided into two portions so as to use the same support frames alternately for each said winding drum.

10. A blind slats lifting mechanism comprising:

a head box having a central portion and opposing end portions;

a pair of ladder cords hung from the opposing end portions of the head box;

a bottom rail carried by the ladder cords;

a plurality of slats disposed between the head box and the bottom rail, the slats being raised in accordance with the lifting of the bottom rail;

a pair of lifting cords for lifting slats, each lifting cord being disposed adjacent to an associated ladder cord, wherein the lower ends of the lifting cords are connected to the bottom rail and the upper ends of the lifting cord are introduced into the head box at respective introducing positions that are located at opposing end portions of the head box; and a pair of support frames disposed at the opposing end portions of the head box;

a pair of winding drums positioned within the central portion of the head box, the winding drums being mounted such that they are integrally rotatable and longitudinally slidable within the head box, the winding drum being arranged to wind the lifting cords spirally around the periphery of the winding drums in accordance with the rotation thereof, said winding drums being arranged on a single axis;

an operation cord for causing the winding drums to rotate;

wherein the lifting cords are arranged to extend substantially longitudinally within the head box towards respective winding positions located in a central portion of the head box, the lifting cords being wound about the winding drums from said winding positions; and wherein the sliding range of each winding drum is set substantially in between the introducing positions of the lifting cords.

11. A blind having a slat lifting mechanism as recited in claim 10, the winding drum having a sliding stroke wherein a distance between the lifting cords is set approximately three times as far as the sliding stroke of the winding drum.

* * * * *